US009707488B2

(12) United States Patent
Lennon

(10) Patent No.: US 9,707,488 B2
(45) Date of Patent: Jul. 18, 2017

(54) TOY VEHICLE, LAUNCHING APPARATUS THEREFOR AND METHODS OF USING THE SAME

(71) Applicant: Mattel, Inc., El Segundo, CA (US)

(72) Inventor: Berrigan August Romig Lennon, Los Angeles, CA (US)

(73) Assignee: Mattel, Inc., El Segundo, CA (US)

( * ) Notice: Subject to any disclaimer, the term of this patent is extended or adjusted under 35 U.S.C. 154(b) by 16 days.

(21) Appl. No.: 14/267,295

(22) Filed: May 1, 2014

(65) Prior Publication Data

US 2014/0329436 A1 Nov. 6, 2014

Related U.S. Application Data

(60) Provisional application No. 61/818,980, filed on May 3, 2013, provisional application No. 61/886,222, filed on Oct. 3, 2013.

(51) Int. Cl.
*A63H 29/00* (2006.01)
*A63H 17/00* (2006.01)

(52) U.S. Cl.
CPC ..... *A63H 17/008* (2013.01)

(58) Field of Classification Search
CPC ..... A63H 17/008; A63H 29/24
USPC ..... 446/429, 430
See application file for complete search history.

(56) References Cited

U.S. PATENT DOCUMENTS 1,914,438 A * 6/1933 Labin ..... A63H 29/06 185/DIG. 1
1,952,547 A * 3/1934 Graves ..... A63H 1/02 446/241
1,985,716 A * 12/1934 Bueschel ..... A63H 1/06 446/241
2,035,531 A * 3/1936 Butcher ..... A63H 27/12 446/43
2,624,977 A 1/1953 Baker
2,645,055 A * 7/1953 Ruczynski ..... A63H 27/12 446/43

(Continued)

FOREIGN PATENT DOCUMENTS

GB 191103483 0/1911

OTHER PUBLICATIONS

Search Report issued in corresponding GB Application No. GB1407793.7 on Oct. 15, 2014.

*Primary Examiner* — Melba Bumgarner
*Assistant Examiner* — Joseph B Baldori
(74) *Attorney, Agent, or Firm* — Sheppard, Mullin, Richter & Hampton LLP

(57) ABSTRACT

A toy vehicle is disclosed that is configured to be driven by a pull cord that is inserted through the axle of a drive wheel of the toy vehicle, such that the drive wheel of the toy vehicle is energized through movement of the driving pull cord in a direction that is generally perpendicular to the direction of intended travel of the toy vehicle. This configuration allows a user to launch multiple toy vehicles arranged in a side-by-side arrangement using a single pull cord, and moreover by pulling such single pull cord through a single pull stroke. This configuration also allows the simultaneous launching of multiple toy vehicles aligned in a single row when multiple pull cords are provided an engage a single actuator to withdraw all such pull cords in a single pulling stroke. Launchers for use with such a toy vehicle, and methods of using the same, are also disclosed.

20 Claims, 15 Drawing Sheets

(56) References Cited

U.S. PATENT DOCUMENTS 2,937,472 A 5/1960 Cunningham
3,216,529 A 11/1965 Lohr
3,246,424 A 4/1966 Gregory
3,471,963 A 10/1969 Tomiyama
3,559,335 A 2/1971 See
3,562,949 A 2/1971 Beny et al.
3,590,524 A 7/1971 Beny et al.
3,621,939 A 11/1971 Hughes
3,686,790 A 8/1972 Winston
3,701,216 A * 10/1972 Smith, III ..... A63F 7/2472 185/39
3,707,805 A 1/1973 Buck
3,733,742 A 5/1973 Terzian
3,735,526 A 5/1973 Ensmann et al.
3,750,328 A 8/1973 Nielsen et al.
3,798,832 A 3/1974 Terzian
3,803,756 A 4/1974 Strongin
3,886,682 A 6/1975 Ieda et al.
3,895,458 A 7/1975 Lemelson
3,932,957 A 1/1976 Morrison et al.
3,955,429 A 5/1976 Holden
3,986,717 A * 10/1976 Kirby ..... A63H 18/14 446/429
4,043,556 A * 8/1977 Lappa ..... A63B 67/00 273/445
4,087,935 A 5/1978 Edmisson et al.
4,108,437 A * 8/1978 DeAnda ..... A63H 17/008 446/429
4,201,011 A 5/1980 Cook
4,291,878 A * 9/1981 Nagel ..... A63H 18/026 446/429
4,406,084 A * 9/1983 D'Andrade ..... A63H 29/18 446/459
4,418,495 A 12/1983 Kennedy et al.
4,463,515 A 8/1984 Barlow et al.
4,472,906 A 9/1984 Cook et al.
4,483,096 A 11/1984 Gabler et al.
4,529,389 A 7/1985 Kennedy et al.
4,541,813 A * 9/1985 Ikeda ..... A63H 18/028 446/424
4,605,229 A * 8/1986 McKay ..... A63H 18/026 446/171
4,715,602 A * 12/1987 May ..... A63H 18/026 446/429
4,872,680 A * 10/1989 Dennis ..... A63F 9/143 238/10 F
4,946,417 A 8/1990 Ishikawa et al.
4,959,035 A 9/1990 Murasaki
5,016,726 A * 5/1991 Metcalf ..... A63C 17/12 280/243
5,643,036 A 7/1997 Liu et al.
5,827,107 A 10/1998 Bears et al.
6,676,476 B1 1/2004 Lund et al.
7,241,223 B1 * 7/2007 Caudill ..... A63F 9/143 463/59
D550,781 S 9/2007 Laurienzo et al.
D554,201 S 10/2007 Vetuskey et al.
D574,442 S 8/2008 Higuchi
7,445,539 B2 11/2008 Laurienzo et al.
7,500,898 B2 3/2009 Laurienzo et al.
7,568,578 B2 8/2009 Berman
7,594,843 B2 9/2009 Vetuskey
D637,661 S 5/2011 Horikoshi
7,950,976 B2 * 5/2011 Bernstein ..... A63H 17/008 446/39
8,568,191 B2 * 10/2013 Rehkemper ..... A63H 33/003 273/108
8,696,401 B2 * 4/2014 Ichikawa ..... A63H 29/20 446/429
8,926,396 B2 * 1/2015 Lennon ..... A63H 29/20 446/233
2006/0121820 A1 6/2006 Laurienzo et al.
2006/0211331 A1 * 9/2006 Trageser ..... A63H 29/24 446/429
2011/0104981 A1 5/2011 Desent et al.
2011/0177750 A1 7/2011 Ujita et al.
2012/0270472 A1 10/2012 Sandoval et al.
2013/0244537 A1 * 9/2013 Lennon ..... A63H 29/20 446/462
2014/0329436 A1 * 11/2014 Lennon ..... A63H 17/008 446/429

* cited by examiner

TOY VEHICLE, LAUNCHING APPARATUS THEREFOR AND METHODS OF USING THE SAME

CROSS-REFERENCE TO RELATED APPLICATIONS

This application is based upon and claims priority from U.S. Provisional Patent Application Ser. No. 61/818,980 entitled "Toy Vehicle, Launching Apparatus Therefor and Methods of Using the Same," filed with the United States Patent and Trademark Office on May 3, 2013 by the inventor herein, and from U.S. Provisional Patent Application Ser. No. 61/886,222 entitled "Toy Vehicle, Launching Apparatus Therefor and Methods of Using the Same," filed with the United States Patent and Trademark Office on Oct. 3, 2013 by the inventor herein, the specifications of which are incorporated herein by reference in their entireties.

FIELD OF THE INVENTION

The present invention relates to toy vehicles, and more particularly to a toy vehicle and launcher assembly configured to allow simultaneous launching of multiple toy vehicles, and methods of launching such toy vehicles.

BACKGROUND

Toy vehicles have long provided children fun and exciting entertainment. Moreover, providing mechanisms to propel a toy vehicle adds to the enjoyment of playing with a toy vehicle, often allowing the toy vehicle to travel faster and farther than if simply pushed by the child playing with the toy.

Toy vehicles have previously been provided that utilize a pull cord, often including a rack gear, to energize a drive system that ultimately launches the toy vehicle. Toy vehicle launch assemblies of varying complexity have been provided that allow the user to manually operate such a pull cord, and thus manually control the amount of energy that is imparted to the toy vehicle through the launcher's drive drain, in turn allowing the user to have some effect on the speed at which the toy vehicle launches from the launcher. For instance, both U.S. Pat. Nos. 3,701,216 and 7,500,898 disclose hand-held launchers that launch a wheel, using a gear rack to rotate an output shaft on the launcher to which the wheel attaches. Likewise, U.S. Pat. No. 4,483,096 discloses a toy vehicle energizer and launcher having a pull cord that rotates an internal drive spool on the launcher, which in turn energizes a drive wheel of the toy vehicle through a clutch mechanism. Further, U.S. Patent Application Publication No. 2006/0121820 discloses a toy propeller launcher having a stationary base that receives a rack gear to engage an internal drive train, which in turn rotates separate launch assemblies to aerially launch toy propellers from each of the launch assemblies.

While manual control, and particularly manual activation and launching of the toy vehicle may be more desirable than, for instance, trigger-spring actuated or motorized launchers (as such manual control creates a more challenging and exciting experience for the user), the above-described prior art devices have provided the user only the opportunity to engage a launcher for the toy vehicle, and not the toy vehicle themselves. Such direct engagement with the toy vehicles themselves can be more desirable to further add to the player's direct control of the action of the toy vehicle as it launches.

Other prior art configurations have been provided for launching such toy vehicles in which a pull cord, typically including a rack gear, directly engages the toy vehicle in a direction generally parallel to the intended path of the toy vehicle. While this configuration may allow more direct control by the user of the action of the toy vehicle as it is launched, it limits the user's ability to adequately position multiple toy vehicles for simultaneous launch, which may be particularly desirable when playing with such toy vehicles in a racing environment. More particularly, separate players must separately engage their pull cord with their respective toy vehicle, and if there is to be an aligned starting line, do their best to align their toy vehicles in a side-by-side position before launching and attempt to hold such position steady during the launching pull. Further, as positioning, holding, and launching of such vehicles in this type of racing configuration requires two hands, a user is limited to either finding a racing partner to control the second toy vehicle, or not being able to play with such toy vehicles in a play racing setting.

It would therefore be advantageous to provide a toy vehicle having a configuration allowing manual launching by the user through direct engagement with the toy vehicle (as opposed to engagement through a separate launcher), but that allows multiple toy vehicles to be launched simultaneously by a single user, and that particularly allows multiple toy vehicles to be manually launched by a single user from an aligned starting position.

SUMMARY OF THE INVENTION

In accordance with certain aspects of an embodiment of the invention, disclosed is a toy vehicle having a drive mechanism that allows a user to simultaneously launch multiple toy vehicles that are aligned next to one another and using a single pull cord actuator. A single pull cord may be inserted through the axle of a drive wheel of the toy vehicle, and may engage a gear mechanism to rotate the drive wheel as the pull cord is withdrawn from the axle. With this configuration, the drive wheel of the toy vehicle is energized through movement of the driving pull cord in a direction that is generally perpendicular to the direction of intended travel of the toy vehicle. This configuration not only provides an easy method by which a user may launch a single toy vehicle, but also provides a configuration that allows a user to launch multiple toy vehicles arranged in a side-by-side arrangement using a single pull cord, and moreover by pulling such single pull cord through a single pull stroke. This configuration also allows the simultaneous launching of multiple toy vehicles aligned in a single row when multiple pull cords are provided and engage a single actuator to withdraw all such pull cords in a single pulling stroke.

In accordance with further aspects of an embodiment of the invention, launchers are provided that make use of such configuration to add excitement to the use of such toy vehicles, and methods of using such toy vehicles with such launchers are also provided.

BRIEF DESCRIPTION OF THE DRAWINGS

The numerous advantages of the present invention may be better understood by those skilled in the art by reference to the accompanying drawings in which.

DETAILED DESCRIPTION OF THE PREFERRED EMBODIMENTS

Figure 1:
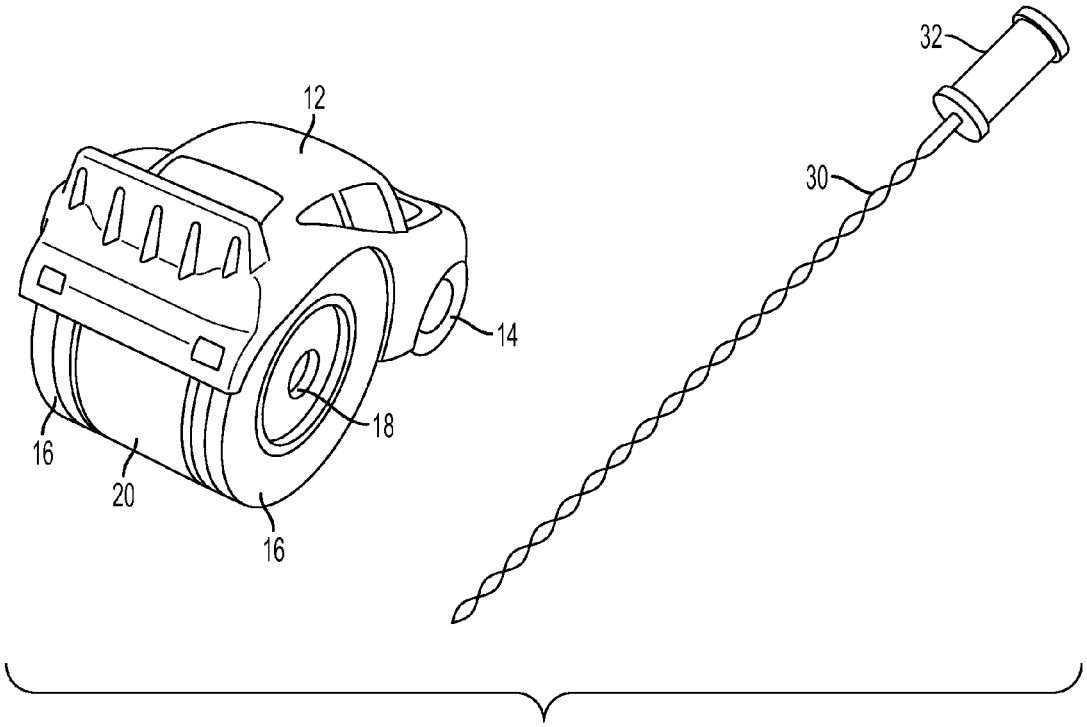
FIG. 1 provides a rear perspective view of a toy vehicle according to aspects of an embodiment of the invention, and of a pull cord suitable for launching such a toy vehicle.
Figure 2:
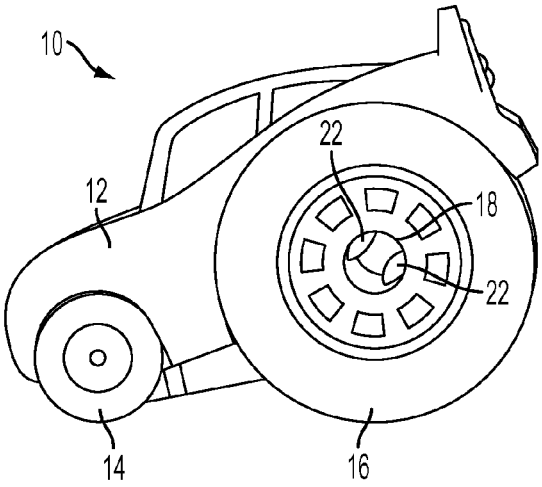
FIG. 2 is a side view of the toy vehicle of FIG. 1.
Figure 3:
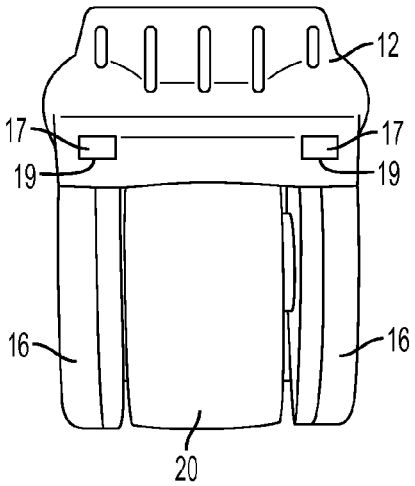
FIG. 3 is a rear view of the toy vehicle of FIG. 1.
Figure 4:
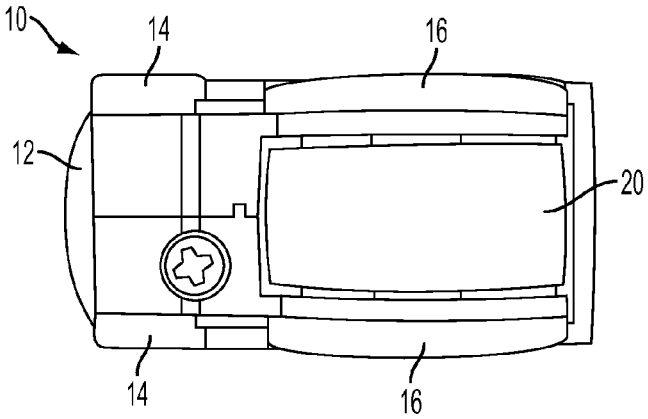
FIG. 4 is a bottom view of the toy vehicle of FIG. 1.

The following description is of a particular embodiment of the invention, set out to enable one to practice an implementation of the invention, and is not intended to limit the preferred embodiment, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

FIGS. 1, 2, 3, and 4 provide perspective, side, rear, and bottom views, respectively, of a toy vehicle according to aspects of an embodiment of the invention. The toy vehicle (shown generally at 10) comprises a vehicle housing 12, front wheels 14, and rear wheels 16. Front wheels 14 and rear wheels 16 may either be fixed or rotatable on an axle extending through vehicle housing 12. If front wheels 14 and/or rear wheels 16 are fixed and non-rotatable, they may be formed of a material that will easily slide across intended play surfaces, such as a smooth wood, tile, concrete, or other smooth flooring surface.

A drive wheel 20 is also provided and rotatably mounted on an axle (as described in greater detail below) and positioned between rear wheels 16 of vehicle housing 12. The outer portion of drive wheel 20 is preferably formed of a material that will easily grip an intended play surface, such as rubber, so as to propel toy vehicle 10 when it spins.

A cylindrical opening 18 extends through vehicle housing 12 and drive wheel 20. Cylindrical opening 18 is preferably aligned with the center of rear wheels 16 and drive wheel 20, and is sized to allow a pull cord 30 (shown in FIG. 1) to be positioned therein and to easily move through opening 18. An input gear structure preferably comprising at least two detents 22 is provided on an interior wall of cylindrical opening 18, and preferably positioned centrally along the length of cylindrical opening 18. Detents 22 are positioned opposite one another on the interior wall of cylindrical opening 18, and are configured to engage spiral pull cord 30, which spiral pull cord 30 has preferably continuous spiral windings along its length that generally resemble the spiral windings on a typical drill bit. More particularly, spiral pull cord 30 may be inserted into one end of cylindrical opening 18 and extend out of the opposite end of cylindrical opening 18. When spiral pull cord 30 is thereafter pulled out of cylindrical opening 18, detents 22 engage the spiral windings of pull cord 30, causing an axle to which detents 22 are attached to spin, in turn spinning drive wheel 20.

Spiral pull cord 30 may include a handle 32 configured for easy gripping by a child. Handle 32 may take on any configuration as will be apparent to those of ordinary skill in the art, so long as it provides a gripping surface or opening allowing easy engagement by a child. In use, a child may hold handle 32 while inserting spiral pull cord 30 through opening 18 in toy vehicle 10, and likewise when quickly pulling pull cord 30 out from cylindrical opening 18 to spin drive wheel 20. Once pull cord 30 has been removed from toy vehicle 10, the child may quickly place toy vehicle 10 on a play surface to allow the toy vehicle to speed away under the power of spinning drive wheel 20. In one embodiment, the pull cord 30 is formed of molded plastic. In alternative embodiments, the pull cord 30 is formed of metal or other materials.

Figure 5:
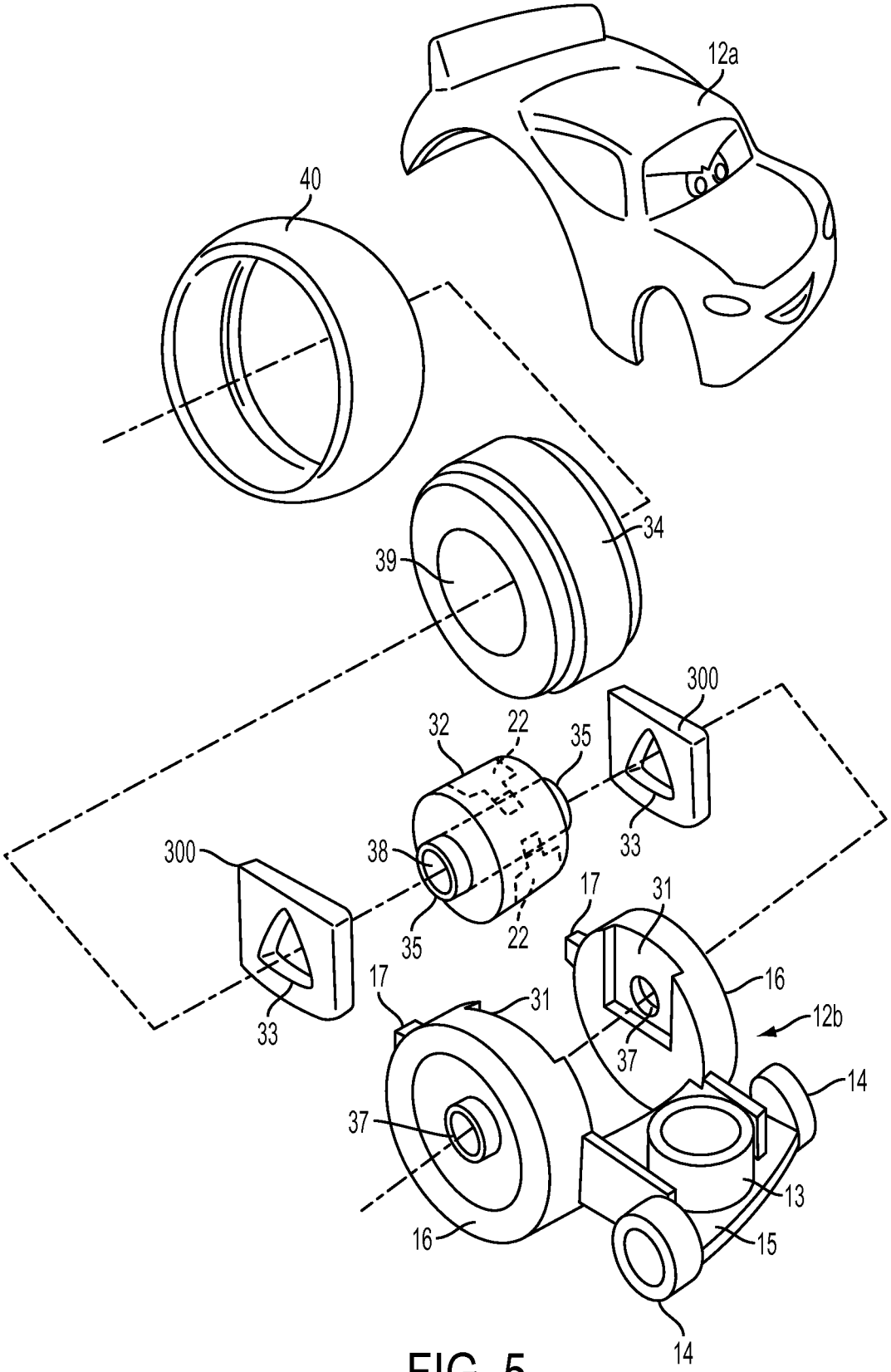
FIG. 5 is an exploded view of the toy vehicle of FIG. 1.

As shown in the exploded view of FIG. 5, vehicle housing 12 may include an upper body portion 12*a* and a vehicle chassis portion (shown generally at 12*b*). Upper body portion 12*a* preferably is shaped in the form of a vehicle, such as an automobile, although other shapes may be provided. Chassis portion 12*b* provides a carriage for carrying upper body portion 12*a* and the toy vehicle drive wheel 20 as further detailed below. Chassis portion 12*b* preferably includes front wheels 14 and rear wheels 16, each of which are attached to undercarriage 15. In the exemplary embodiment shown in the Figures, front wheels 14 and rear wheels 16 are fixed (i.e., non-rotatable) and rigidly attached to undercarriage 15. Alternatively, front wheels and/or rear wheels 16 may be rotatably mounted on chassis 12*b*. Moreover, an additional rotatably mounted wheel (not shown) may be provided on the underside of chassis 12*b*, preferably near the front of chassis 12*b*, to provide added stability and directional control for toy vehicle 10 as it travels along a play surface.

Tabs 17 may be provided on chassis 12*b*, such as at the back portion of cassis 12*b* (e.g., on a rear surface of each of rear wheels 16), which tabs 17 may engage openings 19 on a back side of upper body portion 12*a* (see FIG. 1). Alternatively, tabs 17 may simply engage notches on the interior of upper body portion 12*a* so as to allow upper body portion 12*a* to clip onto, and optionally to be removably held on, chassis 12*b*. An additional connector (not shown), such as a threaded connector (e.g., a screw), may also extend through chassis 15, such as through attachment hub 13, and into a mating receiver (not shown) on the underside of upper body portion 12*a* to attach upper body portion 12*a* to chassis portion 12*b*.

The toy vehicle drive wheel 20 is positioned below upper body portion 12*a* and mounted within chassis portion 12*b*, and comprises axle 32, fly wheel 34, and rubber tire 40, all held within bushings 300. Optionally, tire 40 may have a diameter that is sufficiently large so that rear wheels 16 on chassis 12*b* do not come into contact with a flat play surface when toy vehicle 10 is positioned on such flat surface.

Bushings 300 are configured to closely fit within slots 31 on an interior portion of chassis 12*b*. For instance, slots 31 may be provided on the inner side of rear wheels 16. In an exemplary embodiment, each of slots 31 may be configured with three walls to hold a rectangular-shaped bushing 300 in place, and preferably have an open top allowing such bushing 300 to be slid downward into slot 31. Of course, bushing 300 and slot 31 configurations other than rectangular may likewise be used, so long as each bushing is fixedly held in chassis 12*b* after assembly and during operation of toy vehicle 10. Each bushing 300 also has an opening 33 extending there through, which opening 33 aligns with an opening 37 in each of rear wheels 16. Openings 33 in each bushing 300 are also configured to receive the hubs 35 of axle 32. Openings 33 may be sized so as hold axle 32 while minimizing play between the axle and the chassis portion 12*b*, while also minimizing the amount of friction created between the axle 32 and bushings 300 when axle 32 is spinning. For example, openings 33 in bushings 300 may be configured as triangular openings, and dimensioned to receive circular hub 35 of axle 32 while minimizing the points of contact between bushing opening 33 and hub 35. Other shapes and configurations for such openings 33 in bushings 300 will be apparent to those of ordinary skill in the art.

Axle 32 has a cylindrical channel 38 extending there through, which cylindrical channel 38 forms a portion of opening 18 that extends through the entire vehicle housing 12. Detents 22 are positioned on the interior of axle 32 so that the detents 22 extend into cylindrical channel 38.

Axle 32 is mounted within an open interior 39 of flywheel 34. Flywheel 34 is of standard configuration, and provides a mass to store the rotational energy imparted to axle 32 when pull cord 30 engages detents 22 so as to cause axle 32 to spin. Axle 32 may be press-fit into open interior 39 of flywheel 34, but may also be joined to fly wheel 34 using adhesives, pins, or other fixation devices and/or methods as will be apparent to those skilled in the art.

Likewise, rubber tire 40 is sized to slip over and to be frictionally held to flywheel 34, such that when flywheel 34 spins, rubber tire 40 likewise spins to drive toy vehicle 10 along its path on a play surface.

In use, a user may grip the handle 32 of spiral pull cord 30 and feed spiral pull cord 30 through cylindrical channel 18 until the handle 32 comes in contact with toy vehicle 10. When ready to launch the vehicle, the user may then quickly pull spiral pull cord 30 out of cylindrical channel 18 (thus pulling spiral pull cord 30 in a direction perpendicular to the intended travel path of toy vehicle 10). As spiral pull cord 30 is withdrawn from cylindrical channel 18, detents 22 within cylindrical channel 38 in axle 32 are pushed along the spiral windings on pull cord 30, causing detents 22 to spin about pull cord 30 as it is withdrawn. This, in turn, imparts rotary motion to axle 32, fly wheel 34, and rubber tire 40, with flywheel 34 storing such rotational energy which may then immediately be spent to propel the toy vehicle along its travel path when placed on the play surface.

Optionally, axle 32 may comprise a multi-part drive mechanism that allows multiple pull strokes of spiral pull cord 30 to repeatedly energize drive wheel 20 without removing pull cord 30 from drive wheel 20. By allowing such multiple, driving pull strokes of spiral pull cord 30 without removing pull cord 30 from drive wheel 20, drive wheel 20 may achieve a higher rotational speed before it is released by the user, and will thus cause toy vehicle 10 to be launched at a higher speed than if launched with only a single driving pull stroke.

Figure 6:
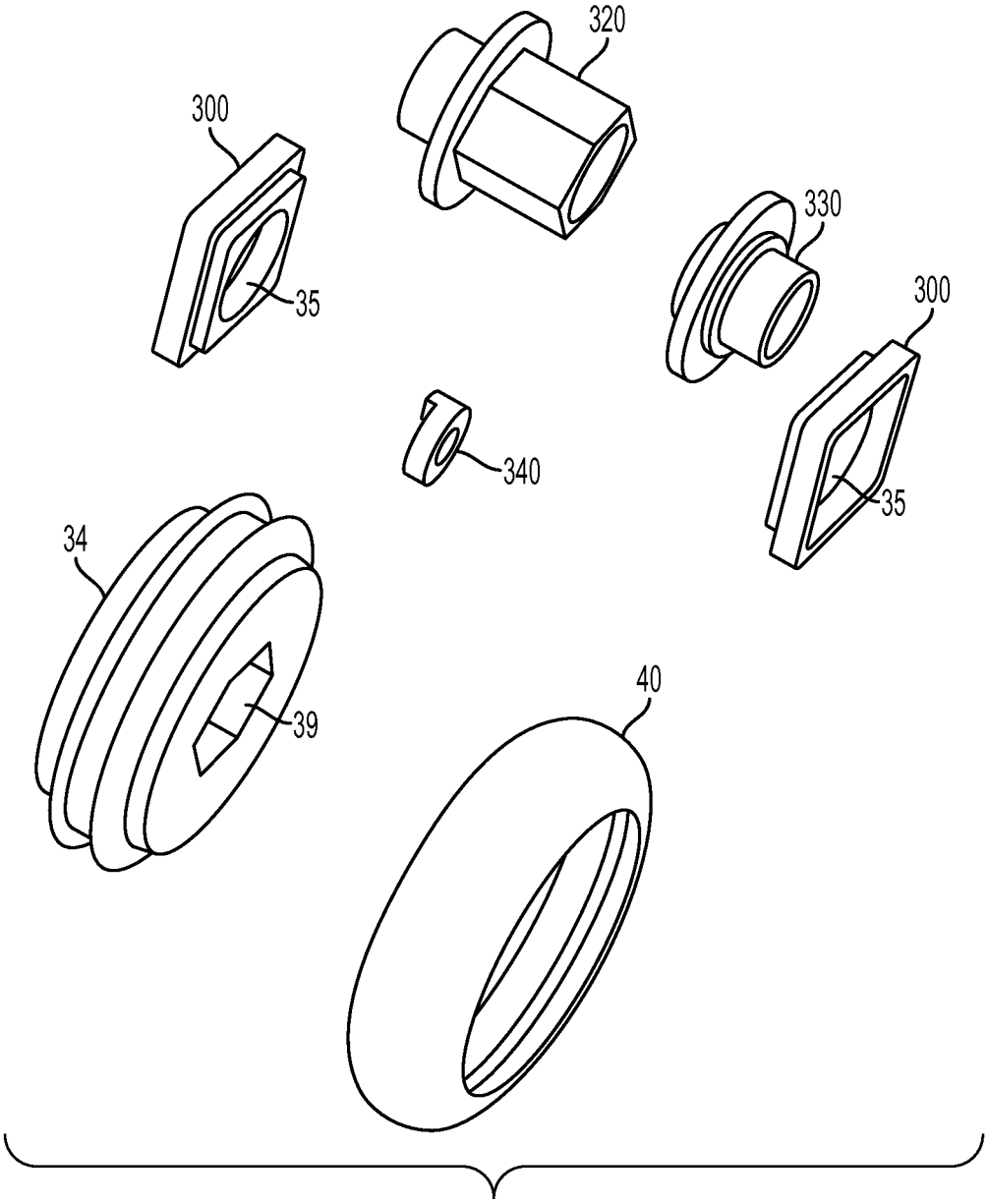
FIG. 6 is an exploded perspective view of a drive axle for use in the toy vehicle of FIG. 1.
Figure 7:
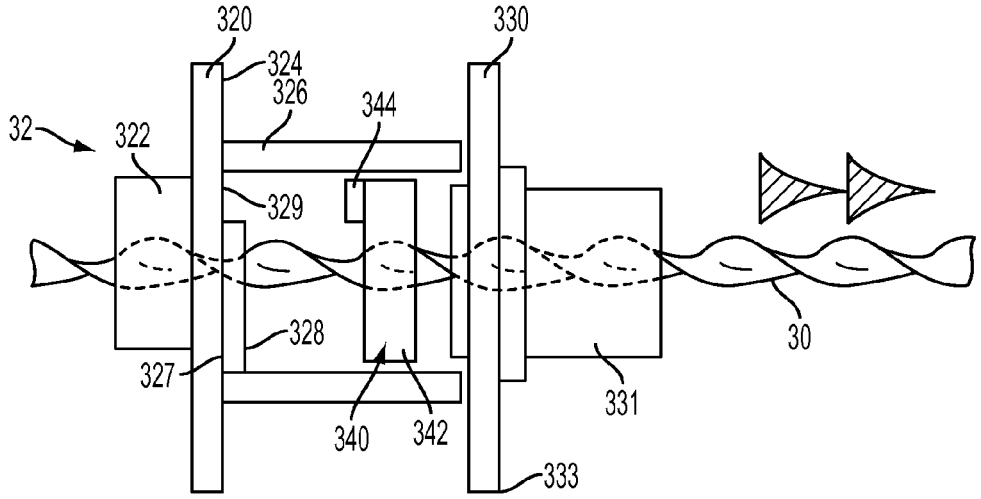
FIG. 7 is a cross-sectional view of the drive axle of FIG. 6 and showing a pull cord being inserted into such drive axle.
Figure 8:
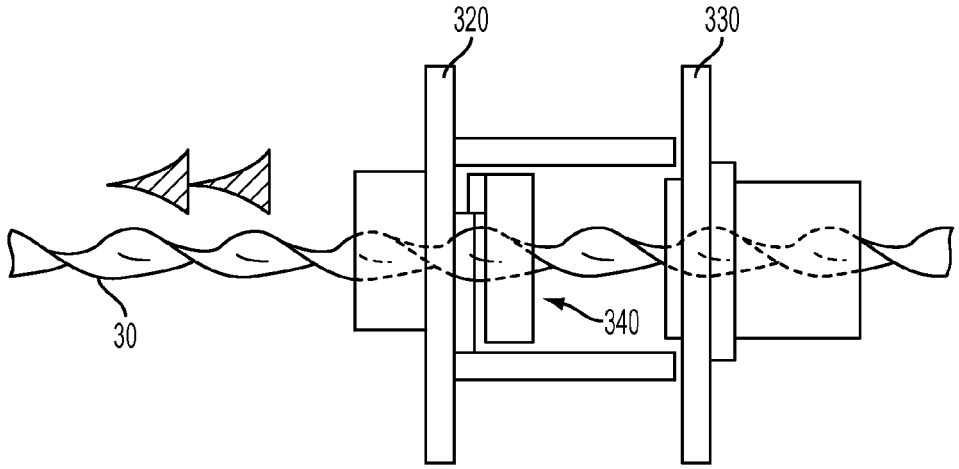
FIG. 8 is a cross-sectional view of the drive axle of FIG. 6 and showing a pull cord being at least partially withdrawn from such drive axle.

With particular reference to FIG. 6, such multi-part drive mechanism comprises an inner bushing 320, a bearing ring 330, and a clutch 340 moveable within inner bushing 320. With reference to FIGS. 6-8, inner bushing 320 has a hollow cylinder 322 at one end sized to fit within opening 35 of bushing 300 while allowing rotation of axle 32 within bearing 300. Inner bushing 320 also has a circular bearing plate 324 that is concentric with cylinder 323. Extending outward from bearing plate 324 on a side opposite hollow cylinder 322 is a polygonal shaft 326. Polygonal shaft 326 thus defines an interior face 327 of bearing plate 324 that is bordered by the interior of polygonal shaft 326. In this configuration, opening 39 extending through flywheel 34 is configured as a polygonal opening whose shape is complementary to polygonal shaft 326, such that they will closely mate with one another when assembled. The interior of polygonal shaft 326 is preferably formed as an open cylinder, through which circular clutch 340 may linearly move back and forth as described in further detail below.

A clutch plate 328 is positioned against interior face 327 of bearing plate 324 on the inside of polygonal shaft 326. Clutch plate 328 extends only partially across interior face 327, such that a gap 329 exists between an end of clutch plate 328 and the interior wall of polygonal shaft 326. Such gap 329 will engage a portion of clutch 340 as described further below.

A bearing ring 330 is positioned within the open end of polygonal shaft 326. Bearing ring 330 includes a hollow cylinder 331 that, like hollow cylinder 322 of inner bushing 320, is sized to fit within opening 35 of bushing 300 while allowing rotation of axle 32 within bearing 300. Bearing ring 330 also includes a bearing plate 333 that closes the open end of polygonal shaft 326 when fully assembled. In such fully assembled form, each of bearing plates 324 and 333 will be positioned adjacent a face of flywheel 34, with polygonal shaft 326 extending through opening 39 in flywheel 34.

Clutch 340 is positioned within polygonal shaft 326 and is configured to move linearly back and forth through polygonal shaft 326 when engaged by spiral pull cord 30. Clutch 340 comprises a disk portion 342 having a central opening extending therethrough, and a hub 344 extending outward from one side of disk portion 342 and toward clutch plate 328. The central opening through disk portion 342 may include detents 22 (FIG. 2) or any other engagement device for engaging the threads of spiral pull cord 30 that will cause clutch 340 to rotate as the pull cord 30 is pulled through the central opening in disk portion 342. Hub 344 is shaped so as fit within gap 329 between clutch plate 328 and the interior of polygonal shaft 326. Also, clutch 30 is moveable back and forth within polygonal shaft 326, and likewise may freely rotate with respect to the rest of inner bushing 320.

When fully assembled, openings in each of hollow cylinder 322, bearing plate 324, clutch plate 328, clutch 340, bearing plate 333 and hollow cylinder 331 are axially aligned, such that spiral pull cord 30 may be inserted through the entire axle assembly 32.

In use, and with particular reference to FIGS. 7 and 8, spiral pull cord 30 may be inserted into and through axle assembly 32 by feeding spiral pull cord 30 into inner bushing 320, through clutch 340 and out through bearing ring 330. As spiral pull cord 30 is inserted into axle assembly 32, and particularly through clutch 340, it will push clutch 340 toward bearing ring 330. Once clutch contacts bearing ring 330, as pull cord 30 is further inserted through axle 32, clutch 340 will spin freely within the interior of polygonal shaft 326, and will continue to do so until spiral pull cord 30 has completed its insertion stroke. Thereafter, as the user begins to pull spiral pull cord 30 through its driving pull stroke, clutch 340 will initially be carried by spiral pull cord 30 toward clutch plate 328, until it contacts clutch plate 328. At that point, unless hub 344 happens to already be aligned with gap 329, clutch 340 will spin until hub 344 comes into alignment with gap 329, at which point clutch 340 will shift further toward bearing plate 324 so that hub 344 fully engages gap 329. Once hub 344 has fully engaged gap 329, further withdrawal of spiral pull cord 30 through axle 32 will cause clutch 340 to spin, which in turn will (through engagement of hub 344 against clutch plate 328) cause inner bushing 320 to spin, in turn spinning drive wheel 34.

Thereafter, if the user wishes to further energize flywheel 34, prior to fully withdrawing spiral pull cord 30 from the drive wheel assembly 20, the user may push spiral pull cord 30 back into axle 32, thus again pushing clutch 340 back toward bearing ring 330 until pull cord 30 completes its insertion stroke. Thereafter, pull cord 30 may again be pulled through its driving pull stroke, causing clutch 340 to re-engage clutch plate 328 and further energize flywheel 34. Once the flywheel is energized to the user's desired level, spiral pull cord 30 may be fully withdrawn from drive wheel 20, and the toy vehicle 10 may be released to race along the play surface.

By configuring toy vehicle 10 so that the drive wheel 20 may be engaged and energized by moving a pull cord in the same direction as the axle of the drive wheel, and thus in a direction that is generally perpendicular to the intended travel path of the toy vehicle 10, a number of options are available for launching the vehicle that add to the excitement experienced by a child engaged in play with the toy vehicle.

For example, one manner of launching toy vehicle 10 that is made available by engaging the drive wheel 20 in a direction that is generally perpendicular to the intended travel path of the toy vehicle 10 is the simultaneous, side-by-side engagement of multiple toy vehicles with a single pull cord configured as above, thus providing a nearly simultaneous launching of multiple toy vehicles that have been positioned side-by-side. For example, and with reference to FIG. 9, a housing (shown generally at 60) may be provided having a plurality of vehicle bays 62, each configured to hold a single toy vehicle 10 configured as above. Housing 60 includes at least a base 64 and a back wall 66. A plurality of partitions 68 extend between base 64 and back wall 66, and are spaced apart from one another to form individual vehicle bays 62 of sufficient width to receive a single toy vehicle 10. Each partition 68 also has an opening 70 extending through the full width of the partition 68, and sized to receive pull cord 30 and to allow pull cord 30 to easily slide there through.

Housing 60 is dimensioned so that when toy vehicles 10 are positioned within vehicle bays 68 (preferably so that the back edge of each toy vehicle 10 is in contact with back wall 66 of housing 60), cylindrical openings 18 extending through each toy vehicle 10 all align with one another and with openings 70 extending through each partition 68. As a result of this configuration, a single pull cord 30 may be fed through a first partition 68, then a first toy vehicle 10, then a second partition 68, then a second toy vehicle 10, and so on for all toy vehicles arranged in housing 60. After pull cord 30 has been so positioned so as to engage the plurality of toy vehicles 10 positioned in housing 60, a single pull of pull cord 30 will result in the simultaneous energizing of the drive wheels 20 of each of the toy vehicles 10 that have been engaged by the pull cord 30. As the pull cord 30 is withdrawn from each of the toy vehicles 10, they will then launch away from housing 60. Moreover, as the pull of pull cord 30 is carried out quickly, the toy vehicles 10 will launch from housing 60 nearly simultaneously.

Figure 9:
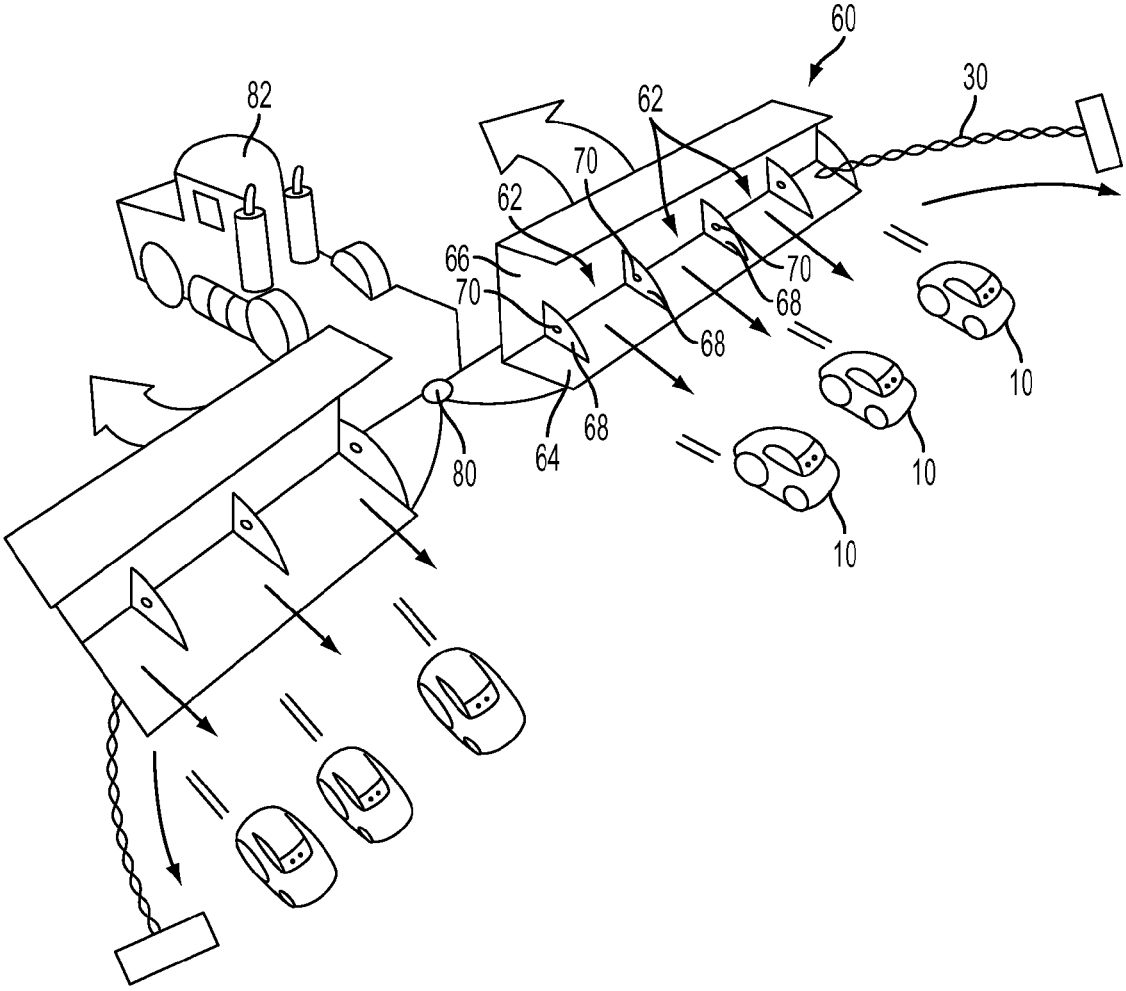
FIG. 9 is a perspective view of an exemplary launcher suitable for launching multiple toy vehicles in a side-by-side arrangement.

As shown in FIG. 9, housing 60 may be provided as a part of a larger play set. For instance, housing 60 may comprise multiple sections, each of which provides a plurality of vehicle bays configured as described above. In the event that multiple sections of housing 60 are provided, they may be hinged together at a hinge 80, thus allowing two sections of housing 60 to fold together to form a more compact enclosure when the play set is not in use. Optionally, additional play set members may also be provided, such as a toy tractor 82, with multi-section housing 60 forming a trailer attached to the tractor at hinge 70 when not in use as a launcher for toy vehicles 10, and folded away from one another (generally into the configuration shown in FIG. 6) to expose the various vehicle bays 62 when in use as a launcher for toy vehicles 10.

Figure 10:
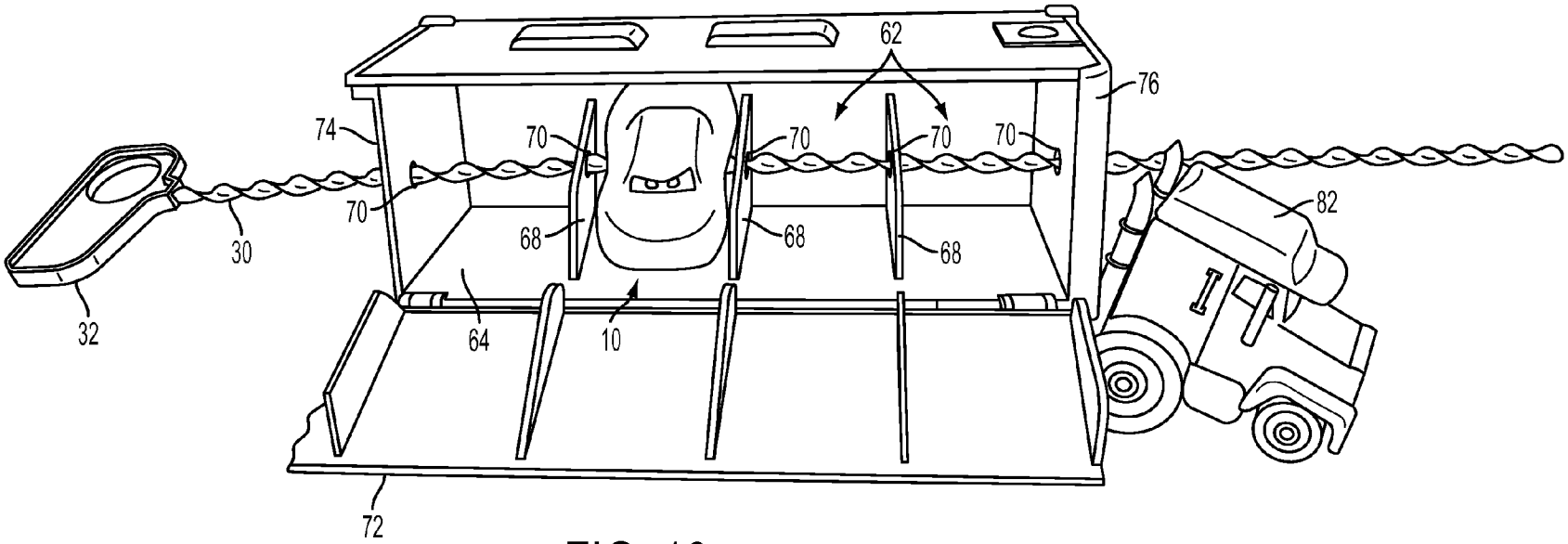
FIG. 10 is a side view of another exemplary launcher suitable for launching multiple toy vehicles in a side-by-side arrangement.

Similarly, and as shown in FIG. 10, housing 60 may include a single section convertible from a closed carrier (e.g., resembling the trailer portion of a toy tractor trailer) to the open, multi-bay launcher housing shown in FIG. 10. A side wall 72 of the trailer is pivotably attached to the trailer body at a side edge of base 64, and pivots downward toward the play surface to create a downwardly oriented ramp for toy vehicles 10 as they are launched from housing 60. While a single toy vehicle 10 is shown in FIG. 10, multiple toy vehicle bays 62 are again defined by partitions 68, such that each toy vehicle bay 62 may receive a toy vehicle 10 and position it in side-by-side alignment with other toy vehicles in the remaining toy vehicle bays 62. Likewise, a single pull cord 30 may pass through openings 70 in partitions 68, in rear wall 74 and in front wall 76, which pull cord 30 passes through each toy vehicle 10 positioned in housing 60. Once again, as pull cord 30 is quickly withdrawn from housing 60, it will energize the drive wheel of each toy vehicle 10 positioned in housing 60, causing it to launch away from its individual vehicle bay 62, down the ramp define by side wall 72, and onto the play surface.

Figure 11A:
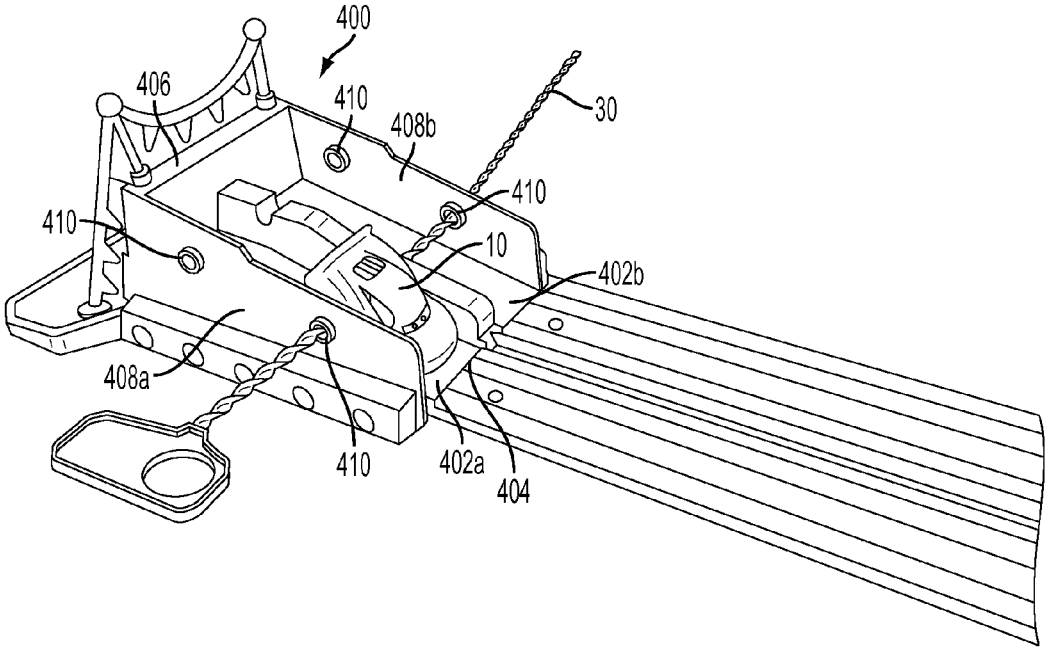
FIG. 11*a* is a perspective view an another exemplary launcher suitable for launching multiple toy vehicles in a side-by-side arrangement.

Further, FIG. 11*a* shows another launcher (shown generally at 400) configuration that may benefit from the simultaneous, side-by-side engagement of multiple toy vehicles with a single pull cord configured as above. Launcher 400 provides two launching lanes 402*a* and 402*b*, each of which is sufficiently wide to receive a toy vehicle 10 therein. Each lane 402*a* and 402*b* is preferably angled upward from a front edge 404 of launcher 400 toward a back wall 406 of launcher 400. A first side wall 408*a* is positioned along an outer edge of launching lane 402*a*, and a second side wall 408*b* is positioned along an outer edge of launching lane 402*b*. Aligned openings 410 may be provided in each of side walls 408*a* and 408*b*, which openings are sized to receive pull cord 30, allowing such pull cord 30 to pass through first sidewall 408*a*, through toy vehicles 10 positioned in each of launching lanes 402*a* and 402*b*, and out through second side wall 408*b*, holding two toy vehicle 10 in alignment in their respective launching lanes. Thereafter, when pull cord 30 is quickly pulled away from first side wall 408*a*, it will be drawn through each aligned toy vehicle 10, energizing the drive wheels of each such toy vehicle 10, and causing the approximately simultaneous launch of aligned toy vehicles 10 positioned in launcher 400.

Figure 11B:
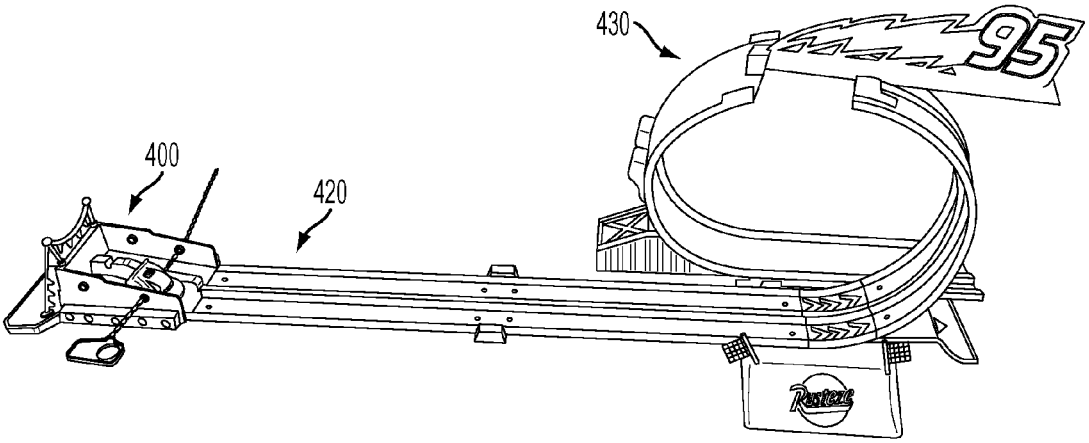
FIG. 11*b* is a perspective view of the launcher of FIG. 11*a* in use with a toy racetrack.

As shown in FIG. 11*b*, such launcher 400 may likewise form part of a larger playset, such as a toy track set having section of extruded track 420 extending outward from front edge 404 of launcher 400, and optionally extending into a stunt feature 430, such as a looped trap section 430 having a gap that the toy vehicle must traverse to successfully travel to the finish line. As the user is able to control the amount of energy that is imparted to the drive wheel of toy vehicle 10 (through controlling the speed and number of pull strokes that they perform before launching toy vehicle 10), successfully traversing the stunt feature 430 may require launching the toy vehicle at the proper speed, and thus require the user to properly control their manual launching of toy vehicles 10.

Figure 12A:
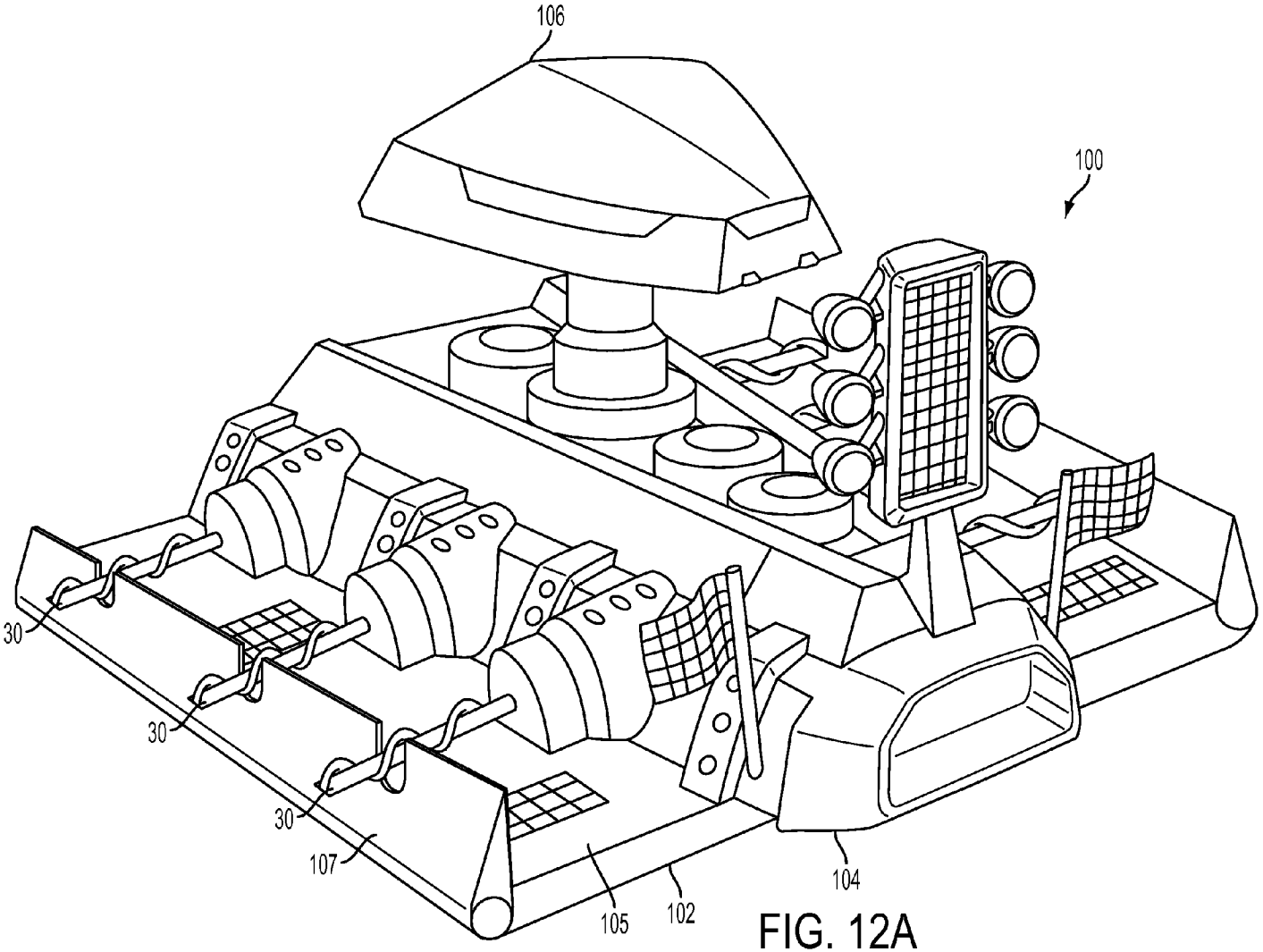
FIG. 12*a* and FIG. 12*b* provide perspective views of a multi-car launcher for use with multiple toy vehicles configured as shown in FIG. 1.
Figure 12B:
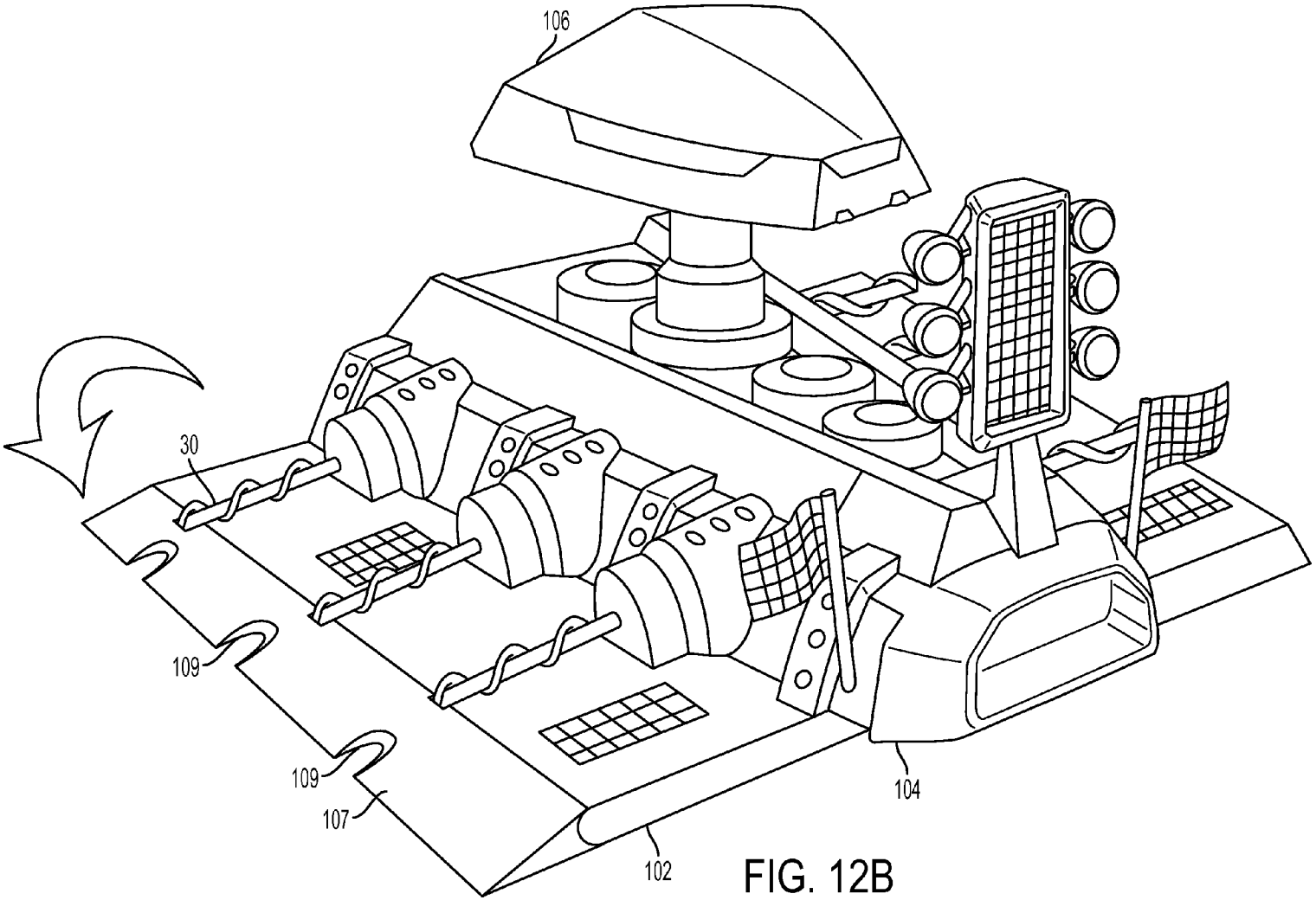

As yet another alternative to launching a plurality of toy vehicles 10 configured as above, a multi-car launcher may be provided that simultaneously launches toy vehicles 10 that are arranged in a line, one behind another. With reference to FIGS. 12*a* and 12*b*, a multi-car launcher (shown generally at 100) is provided having a base 102, a drive housing 104, a plurality of pull cords 30 extending outward from at least one side of housing 104 and being retractable into housing 104, and a push handle 106 that may be pushed downward into housing 104 to cause a drive mechanism in drive housing 104 to simultaneously retract pull cords 30. A start lane 105 is defined on the top face of base 102 between drive housing 104 and an outer edge of base 102. Start lane 105 is of sufficient width to receive at least one toy vehicle 10 configured as described above, and of sufficient depth so as to allow a plurality of such toy vehicles 10 to be aligned in start lane 105. Each pull cord 30 extends outward from drive housing 104 and across start lane 105. Thus, when a user wishes to use multi-car launcher 100, each of a plurality of toy vehicles 10 may be positioned in start lane 105 with a pull cord 30 extending through cylindrical opening 18 on each such toy vehicle 10. When the user then depresses push handle 106 to retract pull cords 30 into housing 104, the pull cords are likewise drawn through the toy vehicle 10 with which it is engaged, thus energizing that toy vehicle's drive wheel 20. Once the pull cords 30 have been fully withdrawn from the toy vehicles in travel lane 105, each of their drive wheels 20 simultaneously engage base 102 to propel the toy vehicles along their path of travel.

Those of ordinary skill in the art will recognize that base 102 is not necessary for allowing the simultaneous, multi-car launching described here, and that housing 104 might instead be positioned directly on a play surface so that the drive wheels 20 of the toy vehicles immediately come in contact with the play surface when released from their respective pull cords 30.

In some embodiments, base 102 may also include a pivoting edge member 107 that may be manually pivoted from an upright position, as shown in FIG. 12*a*, to a generally flat position in which a bottom side of pivoting edge member 107 rests on the play surface (i.e., on the same surface as the bottom of base 102), as shown in FIG. 12*b*. In this case, pivoting edge member 107 may have a tapered thickness tapering from the full thickness of base 102 on an inner side of pivoting edge member 107 to a thinner, tapered outer side (i.e., the side of pivoting edge member 107 opposite base 102). When folded downward, pivoting edge member 107 may provide a ramp allowing a smooth transition for toy vehicles 10 being launched from multi-car launcher 100, particularly when such toy vehicles veer to the side away from housing 104 as they are launched. When folded upward, pivoting edge member 107 may provide a guide wall to help direct toy vehicles forward along their path of travel. Optionally, pivoting edge member 107 may include notches 109 along its outer most edge configured to receive pull cords 30 therein when pivoting edge member 107 is in its upward position.

Figure 13:
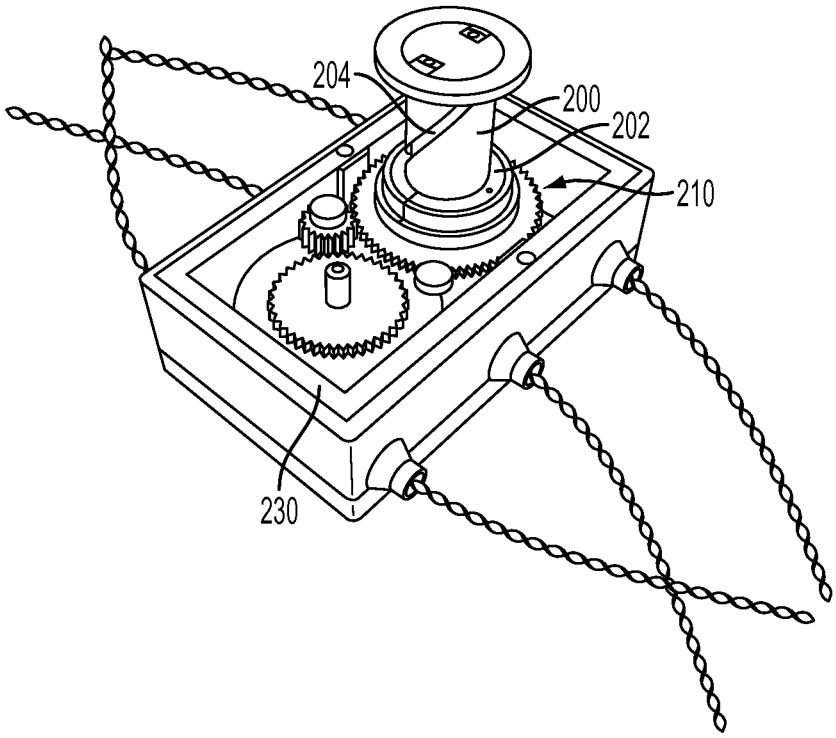
FIG. 13 provides a front perspective view of a drive mechanism for use with the multi-car launcher of FIGS. 12*a* and 12*b*.
Figure 14:
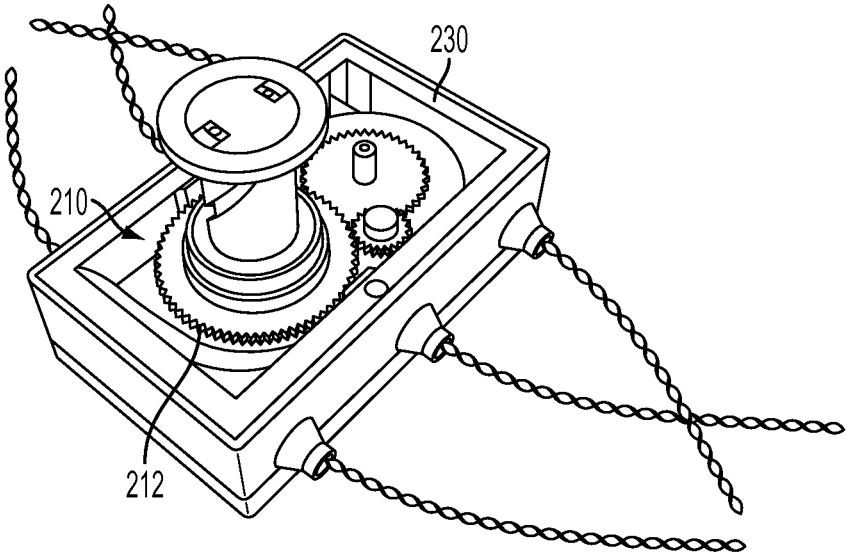
FIG. 14 provides a rear perspective view of the drive mechanism of FIG. 13.
Figure 15:
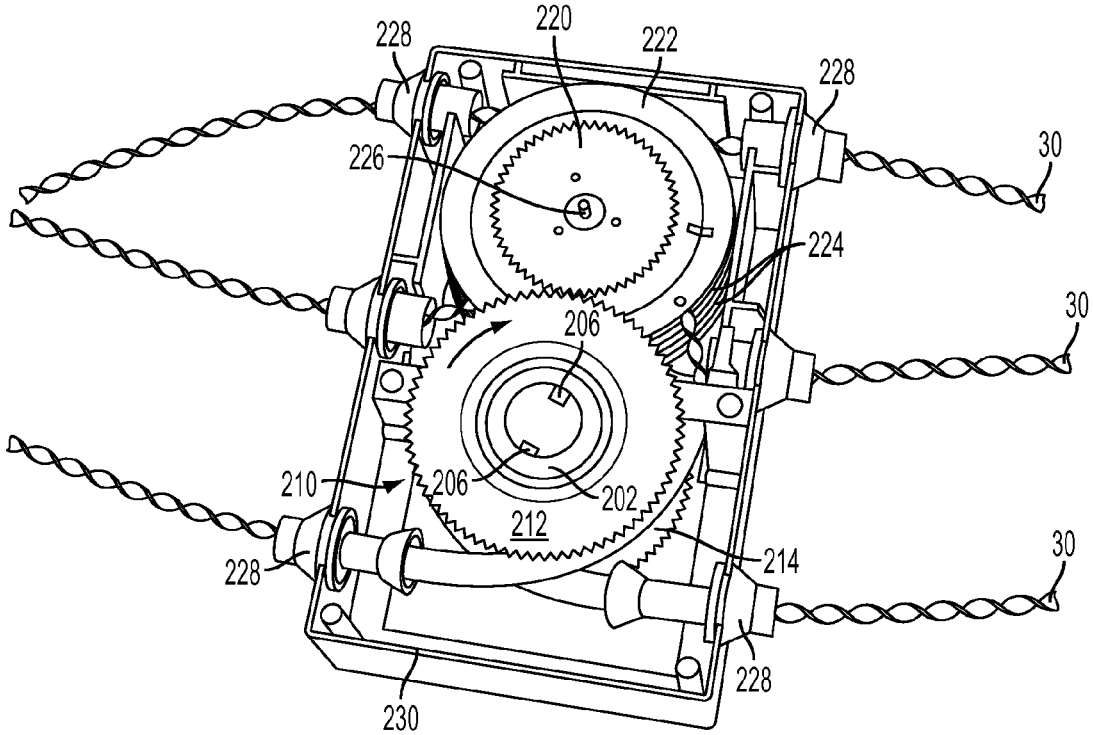
FIG. 15 provides a top perspective view of certain components of the drive mechanism of FIG. 13.

FIG. 13 provides a front perspective view, and FIG. 14 a rear perspective view, of the drive mechanism contained within drive housing 104. Handle 106 may attach to a top side of a spirally grooved drive shaft 200, which spirally grooved drive shaft is configured to slide vertically within a bearing 202. Drive shaft 200 has grooves 204 that spirally wind about shaft 200. As shown in the rear perspective view of the drive mechanism of FIG. 15 (showing the drive mechanism with drive shaft 200 removed), bearing 202 has at least two detents 206 pointing radially inward toward the center of bearing 202 and configured to closely fit within grooves 204 on drive shaft 200. The radial position of drive shaft 200 is fixed (as discussed in greater detail below), such that when drive shaft is pushed down into bearing 202, bearing 202 is forced to rotate about a vertical axis extending upward through the center of bearing 202.

Bearing 202 is also affixed to and positioned centrally within drive gear 210, which has at least a top gear 212, and optionally a bottom gear 214. Drive gear 210 is rotatably mounted within housing 104, and as it is affixed to bearing 202, it will turn with bearing 202 as drive shaft 200 is depressed into bearing 202.

Top gear 212 of drive gear 210 engages pulley gear 220 (either through direct engagement or through one or more intermediate gears as appropriate for a particularly desired gear ratio), which pulley gear 220 is affixed to pulley 222. If drive gear 210 is equipped with a bottom gear 214, then such bottom gear 214 may engage a second pulley gear (not shown) positioned on the bottom of pulley 222. In either case, pulley 222 is likewise rotatably mounted within housing 104. Pulley 222 also has a plurality of circumferential slots 224 that open along the outer circumference of the sidewall of pulley 222. Slots 224 are of sufficient width to receive a pull cord 30 therein, and an end of each pull cord 30 is fixedly attached within a slot 224 of pulley 222. Thus, when pulley 222 rotates about its axle 226 in a first direction, it will simultaneously pull all of pull cords 30 into slots 224 on pulley 222, likewise causing the extended portions of each pull cord 30 (i.e., the portion extending outside of housing 104 and engaging toy vehicles 10) to retract inward toward the interior of housing 104. Similarly, when pulley 222 rotates about its axle 226 in the opposite direction, it will push pull cords 30 outward from slots 224 on pulley 222, likewise causing them to extend outward from housing 104.

Drive gear 210 and pulley 222 may be rotatably mounted within a frame member 230, which frame member may attach to base 102, with housing 104 surrounding frame member 230 when launcher 100 is fully assembled. Alternatively, frame member 230 need not be provided, and drive gear 210 and pulley 222 may instead be directly and rotatably mounted to base 102. Guide members 228 may be provided along the sidewalls of frame member 230 (or alternatively directly to housing 104 if no frame member 230 is provided), each of which has an open interior allowing a single pull cord 30 to extend and slide there through, but each of which guide one of such pull cords 30 as it retracts into and extends outward from housing 104.

Figure 16:
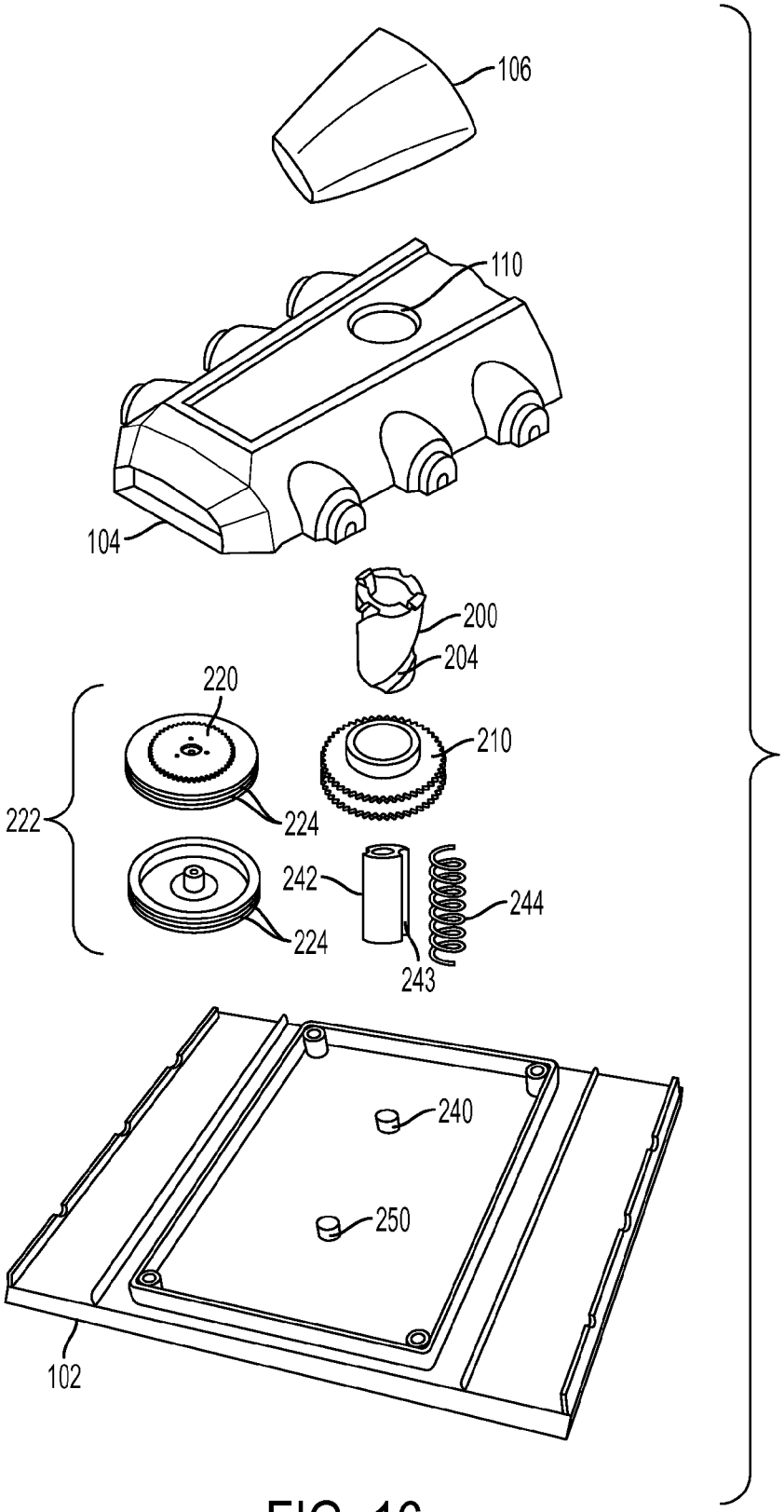
FIG. 16 provides an exploded view of the multi-car launcher of FIGS. 12*a* and 12*b*.

As shown in FIG. 16, regardless of whether drive gear 210 and pulley 222 are mounted within a frame member 230, they are configured to be enclosed within and operatively engage one another within housing 104, which housing 104 is affixed to base 102. A drive gear support post 240 extends upward from base 102 and is configured to rotatably mount drive gear 210 to base 102. A drive gear support shaft 242 is fixedly attached to base 102, and preferably to drive gear support post 240. Drive shaft 200 is hollow on its interior, and is configured within an inner diameter that is dimensioned so as to allow drive shaft 200 to slide vertically up and down over drive gear support shaft 242, and an outer diameter that is dimensioned so as to allow drive shaft 200 to slide vertically up and down within drive gear 210 as discussed above. Drive gear may be provided vertical notches 243, and drive shaft 200 may be provided mating guide surfaces (not shown) that ride along notches 243 so as to prevent angular rotation between drive gear support shaft 242 and drive shaft 200. Drive gear support post 240 thus serves to keep drive shaft 200 stable as it moves up and down through its vertical stroke.

Handle 106 is configured to receive the top of drive shaft 200, such as by clips on drive shaft 200 that may press into openings on the underside of handle 106. An opening 110 is provided in the top side of housing 104 through which drive shaft 200 passes. A spring 244 may be provided and radially positioned between drive gear support shaft 242 and drive shaft 200, biasing drive shaft 200 (and thus handle 106) to an extended position, and being compressed when a user depresses handle 106, thus providing an automatic return of handle 106 to a ready position after each launch.

Similarly, pulley 222 may be rotatably mounted to base 102 at a pulley support post 250, which pulley support post 250 is rigidly attached to base 102. As discussed above, pulley 222 may thus rotate as drive shaft 200 causes drive gear 210 to rotate, in turn causing pull cords 30 that are anchored at one end to pulley 222 to either retract into housing 104 (as handle 106 is pushed downward), or to extend from housing 104 (as handle 106 returns to its original, ready position).

Thus, in operation, a user may first align a series of toy vehicles 10 (configured as discussed above) in a column in a single start lane 105, with a single pull cord 30 extending through each toy vehicle 10. When ready to launch the toy vehicles 10 to initiate a race, a user will depress handle 106 down into housing 104. As handle 106 is depressed into housing 104, drive shaft 200 causes drive gear 210 to rotate, in turn causing pulley 222 to rotate. As pulley 222 rotates, pull cords 30 (which are attached to pulley 222) are quickly retracted into housing 104 as they are wound around pulley 222, thus energizing the drive wheels 20 of each of toy vehicles 10. Once the pull cords 30 have been retracted enough to be fully removed from toy vehicles 10, toy vehicles 10 race off of launcher under the power of each of their drive wheels 20. As the user then releases handle 106, spring 244 returns handle 106 to its original position, lifting drive shaft 200 and causing drive gear to rotate in the opposite direction, in turn causing pulley 222 to rotate in the opposite direction to extend pull cords 30 outward from housing 104.

Figure 17:
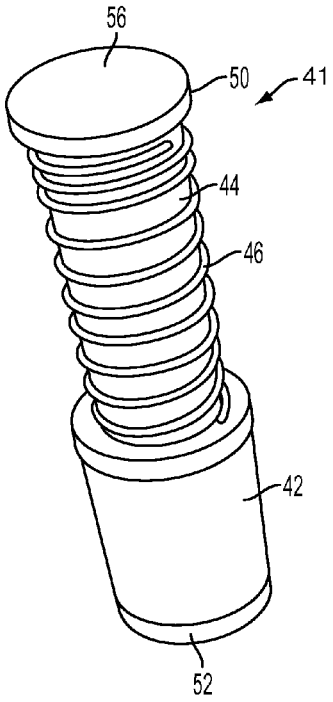
FIG. 17 is a perspective view of a side launcher for use with the toy vehicle and pull cord of FIG. 1.
Figure 18:
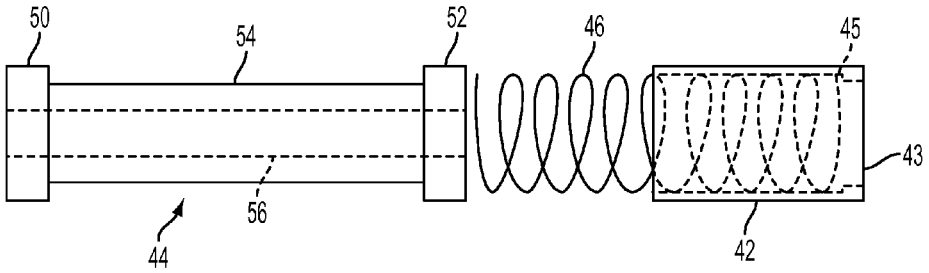
FIG. 18 is an exploded view of the side launcher of FIG. 17.

As shown in the perspective view FIG. 17 and in the exploded view of FIG. 18, and in accordance with still further aspects of any embodiment of the invention, a side launcher (shown generally at 41) may be provided that will cause toy vehicle 10 to be pushed initially in the same direction in which the pull cord is inserted into the toy vehicle 10 (i.e., parallel to the axle of drive wheel 20), and thereafter to continue travel in a forward direction (i.e., perpendicular to the axle of drive wheel 20) as a result of spinning drive wheel 20, such that launching of the toy vehicle 10 begins with a sideways, skidding movement. With reference to FIGS. 17 and 18, side launcher 41 comprises a cylinder 42, a piston 44, and a spring 46. When assembled, piston 44 is slidable within cylinder 42, and spring 46 biases piston towards an extended position (such extended position being reflected in FIG. 17).

More particularly, piston 44 has a first head section 50, a second head section 52, and a rod section 54 extending between head section 50 and head section 52. Second head section 52 is sized so that it forms a stop against the back wall 43 of cylinder 42, thus preventing movement of piston 44 past the extended position shown in FIG. 17. Piston 44 also has a channel 56 extending there through from first head section 50, through rod section 54 and exiting second head section 52, which channel 56 is sized to allow spiral pull cord 30 to easily slide therein. Spring 46 surrounds rod section 54. Spring 46 at one end engages first head section 50, and at the opposite end engages a stop surface (such as ledge 45) on the interior of cylinder 42, such that movement of piston 44 with respect to cylinder 42 will compress spring 46, and when released will cause piston 44 to quickly return to the extended position shown in FIG. 17. Either or both of first head section 50 and second head section 52 may be joined to rod section 54 during assembly of side launcher 41 so as to allow rod section 54 to first be positioned within cylinder 42.

Figure 19:
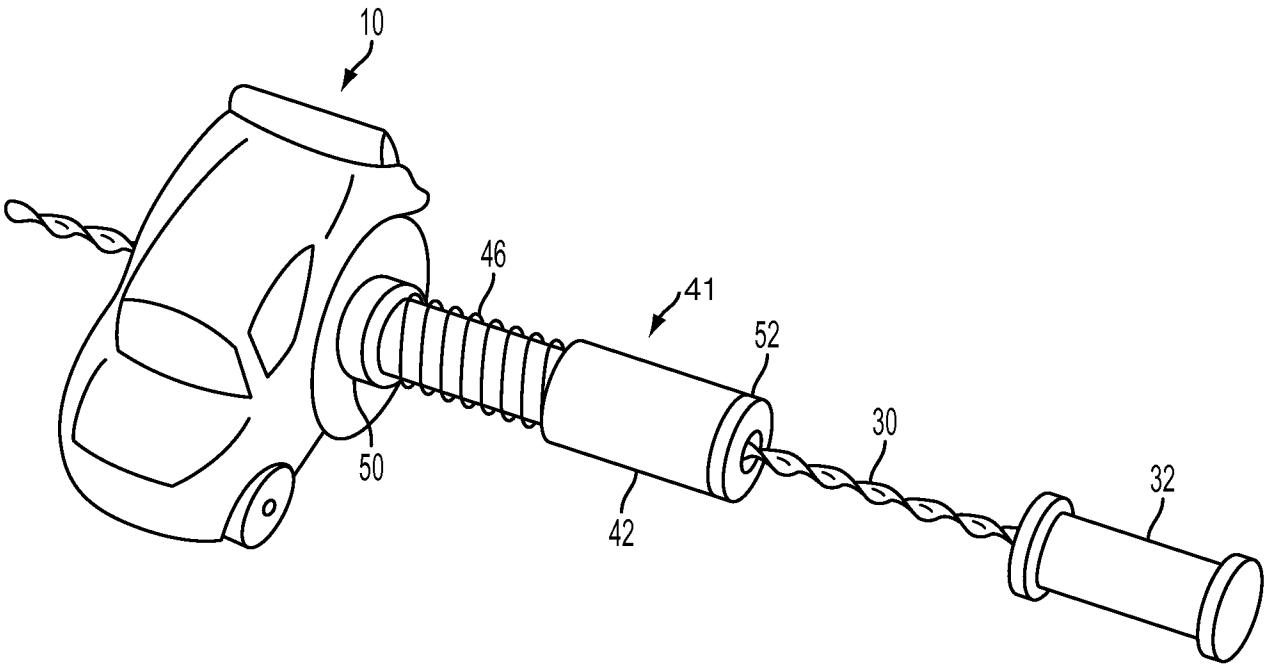
FIG. 19 is a perspective view of the side launcher of FIG. 17 in use with a toy vehicle of FIG. 1.

As shown in FIG. 19, side launcher 41 may be used with toy vehicle 10 and spiral pull cord 30 in the following manner. Spiral pull cord 30 is fed through channel 56 of side launcher 41 and through toy vehicle 10, with first head section 50 positioned against toy vehicle 10. Spiral pull cord 30 is fed in this direction until the front edge of handle 32 comes into contact with second head section 52. When ready to launch, the user (while holding cylinder 42 of side launcher 41 and handle 32 of pull cord 30) will quickly pull handle 32 to withdraw pull cord 30 from toy vehicle 10, thus energizing drive wheel 20 as discussed in detail above. As spiral pull cord 30 is withdrawn, the resistance between the windings of spiral pull cord 30 and the detents 22 in the drive wheel 20 of toy vehicle 10 cause movement of toy vehicle 10 towards cylinder 42 of side launcher 41, causing first head section 50 to compress spring 46. Once pull cord 30 is fully withdrawn from toy vehicle 10, spring 46 rapidly pushes toy vehicle 10 outward in the direction of movement of piston 44. At the same time, drive wheel 20 is spinning so as to direct the toy vehicle forward (i.e., in the direction perpendicular to the direction in which pull cord 30 engaged toy vehicle 10, and in which piston 44 pushes toy vehicle 10). Thus, as toy vehicle 10 is released, it will exhibit a skidding motion, initially moving sideways and then proceeding forward as spinning drive wheel 20 engages the play surface.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It should be understood, therefore, that the invention may be practiced otherwise than as specifically set forth herein.

I claim:

1. A toy vehicle launching system comprising:

a toy vehicle, said toy vehicle further comprising a housing; and a drive wheel rotatably mounted to said housing, said drive wheel having a channel extending through an axle of said drive wheel, and said axle comprising a multi-part drive mechanism comprising an inner bushing and a clutch, wherein said clutch moves in a direction parallel to and rotates about a central axis within said inner bushing; wherein said inner bushing further comprises a clutch plate configured to engage a hub on said clutch so as to translate rotation of said clutch into rotation of said inner bushing; and a cord comprising an elongate gear configured to drivingly engage said clutch;

wherein said clutch moves in a first direction parallel to the axle to engage the hub against the clutch plate, translate rotation of the clutch into rotation of the inner bushing, and energize said drive wheel about said axle, when said cord is moved through said drive wheel in the first direction; and wherein said clutch moves in a second direction parallel to the axle to disengage the clutch plate and to spin freely, and does not energize said drive wheel about said axle, when the cord is moved through said drive wheel in the second direction.

2. The toy vehicle launching system of claim 1, wherein said elongate gear further comprises an elongate shaft of spiral windings wound about a central axis.

3. The toy vehicle launching system of claim 2, wherein said clutch further comprises a disk portion having a central opening extending therethrough and wherein said hub extends outward from one side of said disk portion and toward said clutch plate, said central opening comprising one or more detents configured to ride between said windings of said elongate gear.

4. The toy vehicle launching system of claim 3, wherein the central opening comprises an engagement device for engaging threads of the cord that will cause the clutch to rotate and wherein the hub is shaped to fit within the gap between the clutch plate and the interior of the shaft.

5. The toy vehicle launching system of claim 1, said drive wheel further comprising a cylindrical flywheel; and a tire encircling said flywheel; wherein said axle is mounted within a central portion of said flywheel.

6. The toy vehicle launching system of claim 1, further comprising: a multi-vehicle launcher comprising a base and a partition extending upward from said base and defining at least two starting lanes in said base, each of said starting lanes being sized to receive the toy vehicle, wherein the partition has a cord receiving opening extending there through.

7. The toy vehicle launching system of claim 6, wherein said launcher is configured so as to align said cord receiving opening in said partition with said channel in said toy vehicle when said toy vehicle is positioned in said launcher.

8. The toy vehicle launching system of claim 7, further comprising a second partition wherein the partition and second partition form at least three toy vehicle receiving bays in said launcher.

9. The toy vehicle launching system of claim 1, wherein the cord may be repeatedly moved through said drive wheel in said first and second directions to energize said drive wheel to a desired level before the cord is fully withdrawn.

10. The toy vehicle launching system of claim 1, wherein said multi-part drive mechanism further comprises a bearing ring.

11. The toy vehicle launching system of claim 10, wherein the clutch moves to contact said bearing ring when the cord is moved through said drive wheel in the second direction.

12. The toy vehicle launching system of claim 1, wherein the inner bushing comprises a bearing plate and a shaft extending from the bearing plate, and wherein the shaft has a shape configured to mate with an opening extending through the drive wheel and wherein the clutch moves back and forth within the shaft.

13. The toy vehicle launching system of claim 12, wherein the shaft has a polygonal shape and the opening extending through the drive wheel has a corresponding polygonal shape.

14. A method of launching a toy vehicle, comprising:

providing at least one toy vehicle, said toy vehicle further comprising:

a housing; and a drive wheel rotatably mounted to said housing, said drive wheel having a channel extending through an axle of said drive wheel, and said axle comprising a multi-part drive mechanism comprising an inner bushing and a clutch, wherein said clutch moves in a direction parallel to and rotates about a central axis of said axle within said inner bushing; wherein said inner bushing further comprises a clutch plate configured to engage a hub on said clutch so as to translate rotation of said clutch into rotation of said inner bushing;

providing a cord comprising an elongate gear configured to drivingly engage said clutch; and inserting said cord through said channel of said drive wheel of said toy vehicle;

wherein moving said cord through said channel of said drive wheel of said toy vehicle in a first direction moves the clutch in the first direction to engage the hub against the clutch plate, which translates rotation of the clutch into rotation of the inner bushing and energizes and rotates said drive wheel about said axle; and wherein moving said cord through said channel of said drive wheel of said toy vehicle in a second direction moves the clutch in the second direction to disengage the clutch plate so that the clutch spins freely and does not energize said drive wheel about said axle.

15. The method of launching a toy vehicle of claim 14, further comprising the step of providing a multi-vehicle launcher comprising a base and a partition extending upward from said base and defining at least two starting lanes on said base, each of said starting lanes being sized to receive the toy vehicle, wherein the partition has a cord receiving opening extending there through.

16. The method of launching a toy vehicle of claim 15, wherein said launcher is configured so as to align said cord receiving opening in said partition with said channel in said toy vehicle when said toy vehicle is positioned in said launcher.

17. The method of launching a toy vehicle of claim 16, further comprising a second partition wherein said partition and said second partition form at least three toy vehicles receiving bays in said launcher.

18. The method of launching a toy vehicle of claim 16, further comprising the step of placing said cord through said cord receiving opening and through said channel in a plurality of said toy vehicles positioned in said launcher.

19. The method of launching a toy vehicle of claim 18, further comprising the step of moving said cord through said channel in said plurality of said toy vehicles in a single stroke to launch all of said toy vehicles.

20. The method of launching a toy vehicle of claim 14, wherein the cord may be repeatedly moved through said drive wheel in said first and second directions to energize said drive wheel to a desired level before the cord is fully withdrawn.

* * * * *